United States Patent [19]

Erdei

[11] Patent Number: 5,069,473

[45] Date of Patent: Dec. 3, 1991

[54] SKI BRAKE

[75] Inventor: Roland Erdei, Weigelsdorf, Austria

[73] Assignee: TMC Corporation, Baar, Switzerland

[21] Appl. No.: 554,736

[22] Filed: Jul. 18, 1990

[30] Foreign Application Priority Data

Sep. 1, 1989 [AT] Austria ..... 2069/89

[51] Int. Cl.[5] ..... A63C 7/10

[52] U.S. Cl. ..... 280/605; 188/8; 280/607; 280/636

[58] Field of Search ..... 280/605, 604, 607, 636, 280/28.11, 900; 188/5, 8, 2 D, 32

[56] References Cited

U.S. PATENT DOCUMENTS

| | | | |
|---|---|---|---|
| 2,350,130 | 5/1944 | Rinkinen | 280/607 |
| 3,101,205 | 8/1963 | Benham | 188/2 D |
| 4,061,356 | 12/1977 | Salomon | 280/605 |

FOREIGN PATENT DOCUMENTS

| | | | |
|---|---|---|---|
| 384365 | 11/1987 | Austria . | |
| 384554 | 12/1987 | Austria . | |
| 2600850 | 7/1977 | Fed. Rep. of Germany . | |
| 2646091 | 4/1978 | Fed. Rep. of Germany . | |
| 3709802 | 10/1988 | Fed. Rep. of Germany . | |
| 3712807 | 11/1988 | Fed. Rep. of Germany . | |
| 3818569 | 4/1989 | Fed. Rep. of Germany | 280/607 |

*Primary Examiner*—Andres Kashnikow
*Assistant Examiner*—Eric Culbreth
*Attorney, Agent, or Firm*—Flynn, Thiel, Boutell & Tanis

[57] ABSTRACT

A ski brake including two wire-braking arms supported in bearing points on a ski, which wire-braking arms are, if necessary, combined to one wire bar. The ski brake can be swung from a braking position into a ready position, in which the ski brake is stepped down upon by a ski boot and is held down with the help of an operating pedal arranged pivotally about a transversely extending axle, with the free ends of the wire-braking arms being held lying above the plane of the upper side of the ski. The bearing points of the wire-braking arms are arranged on the upper side of the ski. At least one further bearing point for the operating pedal is constructed on or in a spring board spaced above the upper side of the ski and movable relative to the ski. It is furthermore important that the wire-braking arms have an operating member, and that the operating member is coupled with the operating pedal by a device permitting unhindered movability of the spring board in direction normally with respect to the upper side of the ski.

4 Claims, 4 Drawing Sheets

SKI BRAKE

FIELD OF THE INVENTION

The invention relates to a ski brake.

BACKGROUND OF THE INVENTION

Such ski brakes are known in many variations and have proven themselves in practice. For example, reference is here made to AT-B-384 554. It has been suggested many times in the past not to mount ski bindings for the absorption of undesired vibrations directly on the ski but on a shock absorber fastened on the ski or on a spring board. Such a spring board is known for example from DE-Al-37 12 807. Another solution (shock absorber) is disclosed in DE-Al-37 09 802.

When using such spring boards, the problem results that the braking mandrels in the active braking position of the ski brake do not extend sufficiently far beneath the plane of the running surface of the ski because of the mounting position, which is elevated compared with the ski, in order to guarantee a safe braking action. A simple extension of the braking mandrels for the height of the spring board does thereby not offer a practical utilizable solution since this, on the one hand, would further increase the total weight and, on the other hand, the braking mandrels would project rearwardly in the ready position (skiing position) of the ski brake far beyond the heel holder and the spring board, which would unacceptably increase the risk of getting caught on obstacles and the risk of injury.

It is known from AT-B-384 365 to arrange the operating pedal for a ski brake on a footboard above the ski, however, the footboard in this known ski brake is not arranged resiliently in elevational direction. However, this reference does not disclose any solution to the problem of how a ski brake can be arranged on a spring board so that neither the spring movement nor the function of the ski brake are influenced.

In order to be complete DE-Al-26 46 091 is pointed out, in which the operating pedal and the ski brake are arranged spaced from one another. However, the operating pedal and the ski brake are in this known solution spaced from one another in longitudinal direction of the ski with both structural parts being mounted on the upper side of the ski. This solution lies therefore farther from the subject matter of the invention than the already considered state of the art.

The goal of the invention is to provide a ski brake of the above-mentioned type such that a reliable braking of the ski after the (voluntary or caused by a fall) removal of the ski boot from the binding is guaranteed also when the ski binding is not directly mounted on the upper side of the ski but spaced therefrom on a plate movable in elevational direction relative to the ski, for example on a spring board.

This special arrangement of the ski brake guarantees that the braking mandrels project in the braking position, independently from the distance of the ski binding, caused by the spring board, from the upper side of the ski, always sufficiently far beneath the running surface of the ski so that a reliable braking action can always be achieved.

The concept of using a pulling mechanism to operate a ski brake is already known, as shown in DE-Al-26 00 850. However, the solution disclosed in this reference can only be applied if operating pedal and braking member do not change their position relative to one another.

Due to the fact that a control wire is used, with the outer jacket of the control wire being supported at its two end sections by means of two mountings, of which the one is fastened on the ski and the other one on the spring board, and that the cord of the control wire engages with its first end section on the operating member and with its other end section on a load arm of the operating pedal, it is achieved in a particularly favorable and reliable manner that the relative movement between spring board and ski does not have any effects on the function of the ski brake.

BRIEF DESCRIPTION OF THE DRAWINGS

The characteristics, advantages and details of the ski brake of the invention will now be described in connection with the drawings, in which.

DETAILED DESCRIPTION

Figure 1:
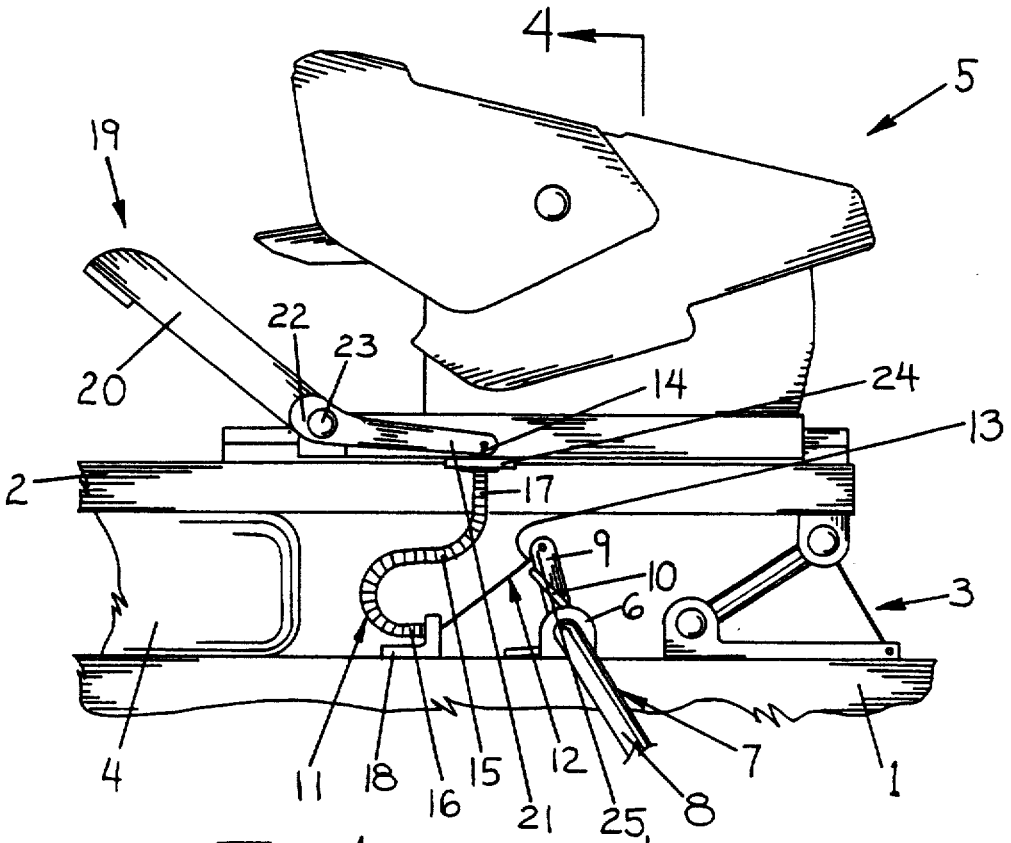
FIGS. 1 to 4 illustrate thereby a first embodiment of the ski brake of the invention, with the ski brake being shown in a side view in FIGS. 1 to 3 and, in FIG. 4, a partially cross-sectional view taken along the line IV—IV of FIG. 1.

Structural parts, which are the same in the various exemplary embodiments, are identified by the same reference numerals in the following description of the figures.

A conventional and, therefore, not in detail described spring board 2 is fastened on a ski by means of a hinge mechanism in FIG. 1. Reference numeral 4 identifies a spring, which in this exemplary embodiment is constructed as an air spring; of course it would also be possible to use a leaf spring, a helical spring or other spring means, as for example a plate or a block of a material having resilient characteristics (plastic, rubber). A heel holder 5 of any desired conventional type is mounted on the spring board 2.

Two bearing points 6 for each wire-braking arm 7 are fastened on the ski 1. The wire-braking arms 7 consist of multiply bent spring wire and are designed symmetrically. The free ends of the wire-braking arms 7 are designed as braking mandrels 8 and can have, for example, a plastic coating here not illustrated. The wire-braking arms 7 have an operating member 9 and are biassed by an erecting spring 10 in direction of the active braking position of the ski brake. The design of such wire-braking arms and bearing points is known to the man skilled in the art, and therefore is not part of the subject matter of the invention and is not described in detail. A first end section 13 of a cord 12 of a control wire 11 engages the crossbar 25 of the operating member 9. The outer jacket 15 of the control wire 11 is fastened with its first end section 16 on a ski-fixed mounting 18.

The second end section 14 of the cord 12 of the control wire 11 remote from the operating member 9, is fastened on a weight arm 21 of an operating pedal 19 designed as a two-arm lever. The force arm of the operating pedal 19 is designed as a stepping plate 20. The operating pedal 19 is hinged to a transverse axle 23 arranged in a further bearing point 22. The further bearing point is in this exemplary embodiment constructed directly on the heel holder 5. Furthermore, a second mounting 24 for a second end section 17 of the outer jacket 15 of the control wire 11 is provided on the spring board 2.

Figure 2:
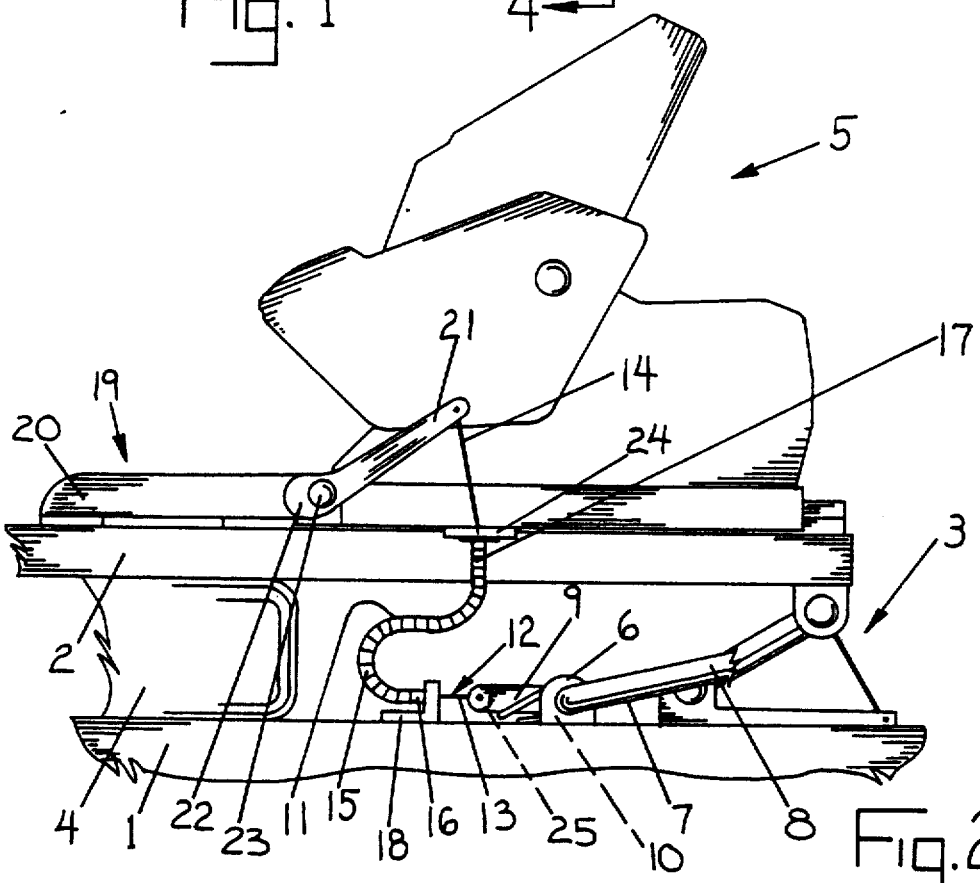

As can be recognized in FIG. 2, stepping down on the stepping plate 20 of the operating pedal 19 results in the weight arm 21 being swung upwardly and thus the operating member 9 being pulled in direction of the ski-fixed abutment 18 by means of the control wire 11. The braking mandrels 8 are thus swung upwardly into the ready position.

Figure 3:
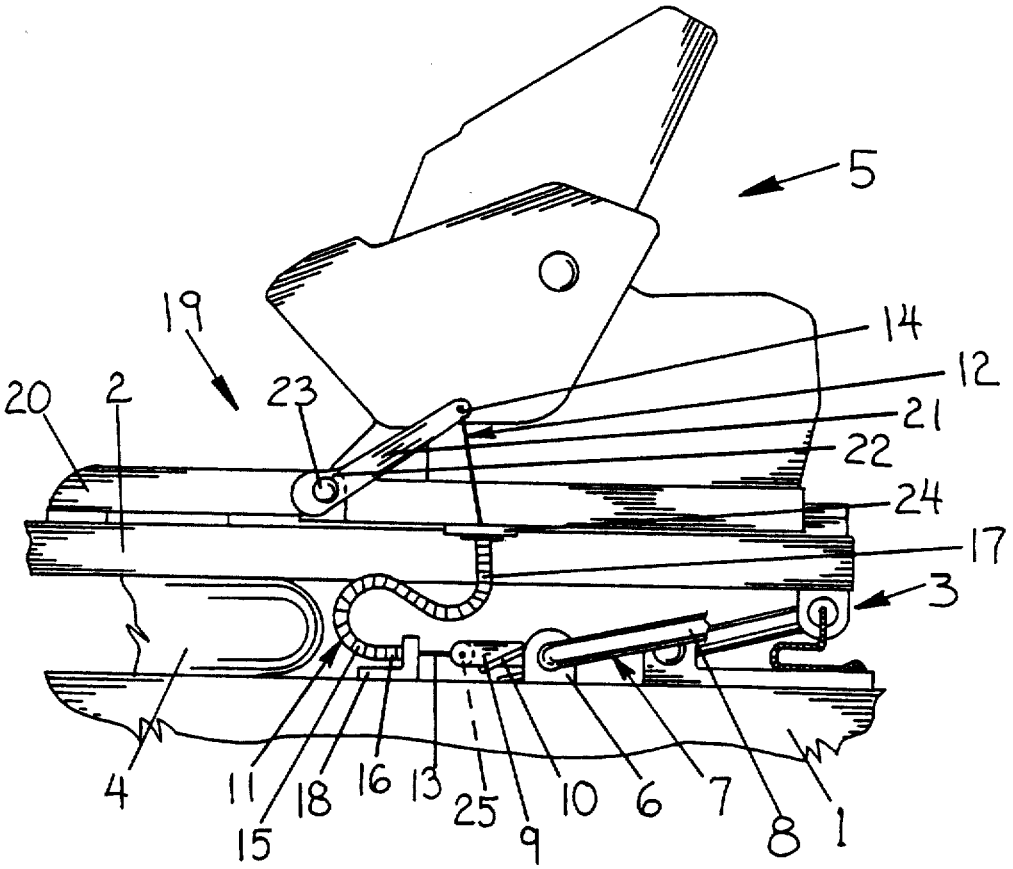
Figure 4:
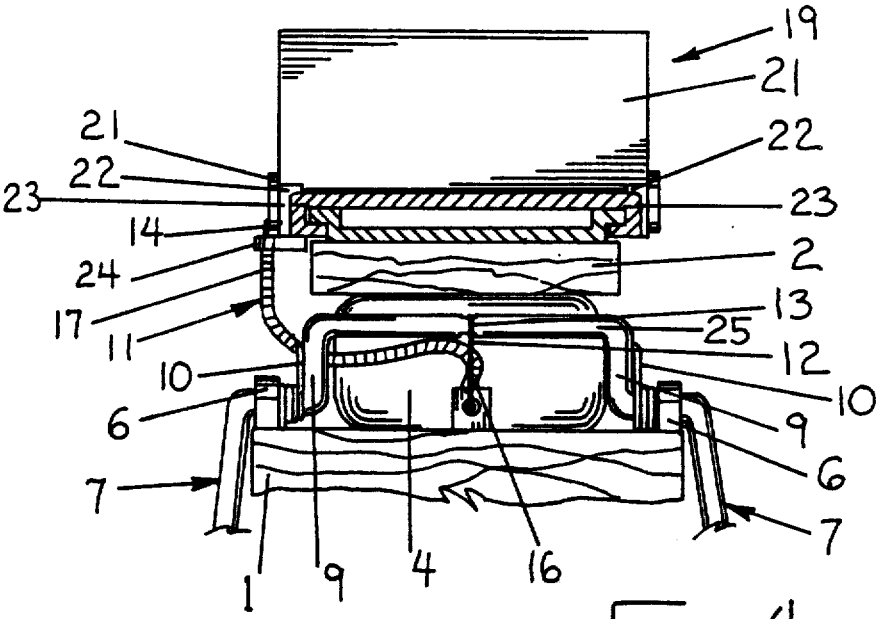

FIG. 3 clearly shows that a relative movement, resisted by the spring 4, of the spring board 2 is possible without interference by the ski brake.

Figure 5:
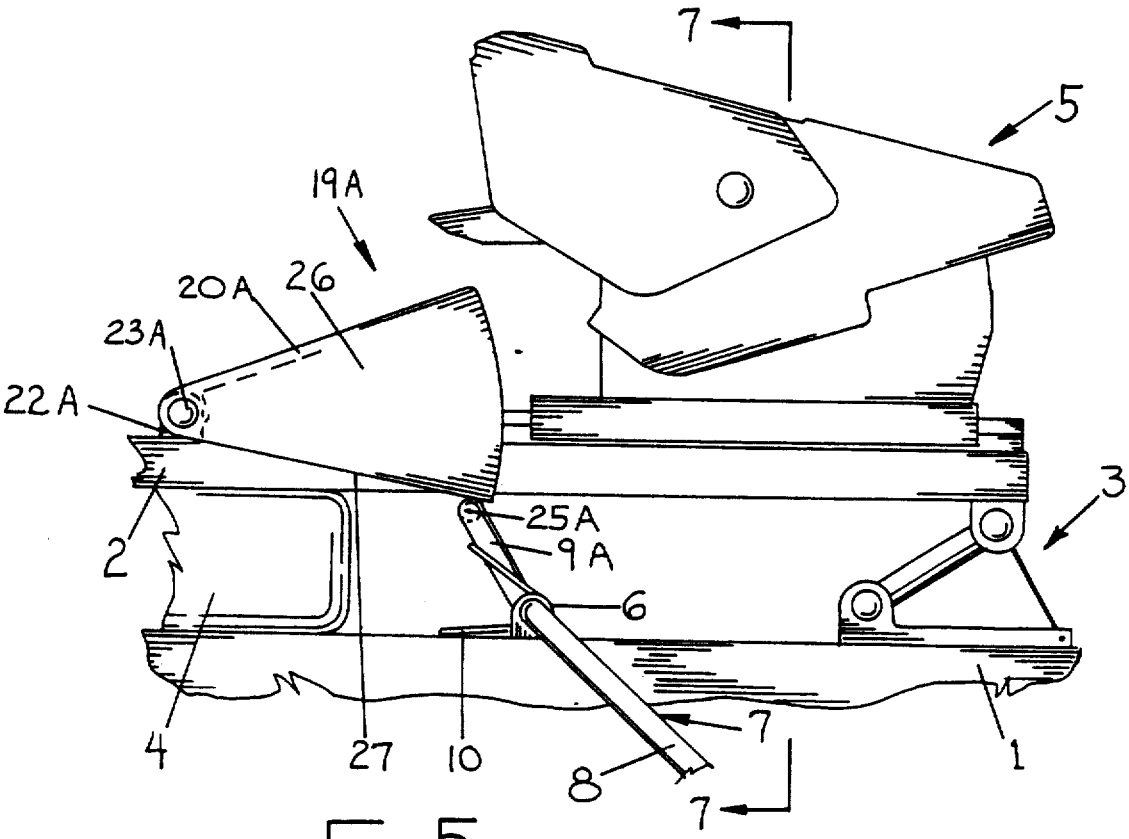
FIGS. 5 to 7 illustrate a second embodiment, with the ski brake being shown in a side view in FIGS. 5 and 6 and, FIG. 7, in a partially cross-sectional view taken along the line VII—VII of FIG. 5.
Figure 6:
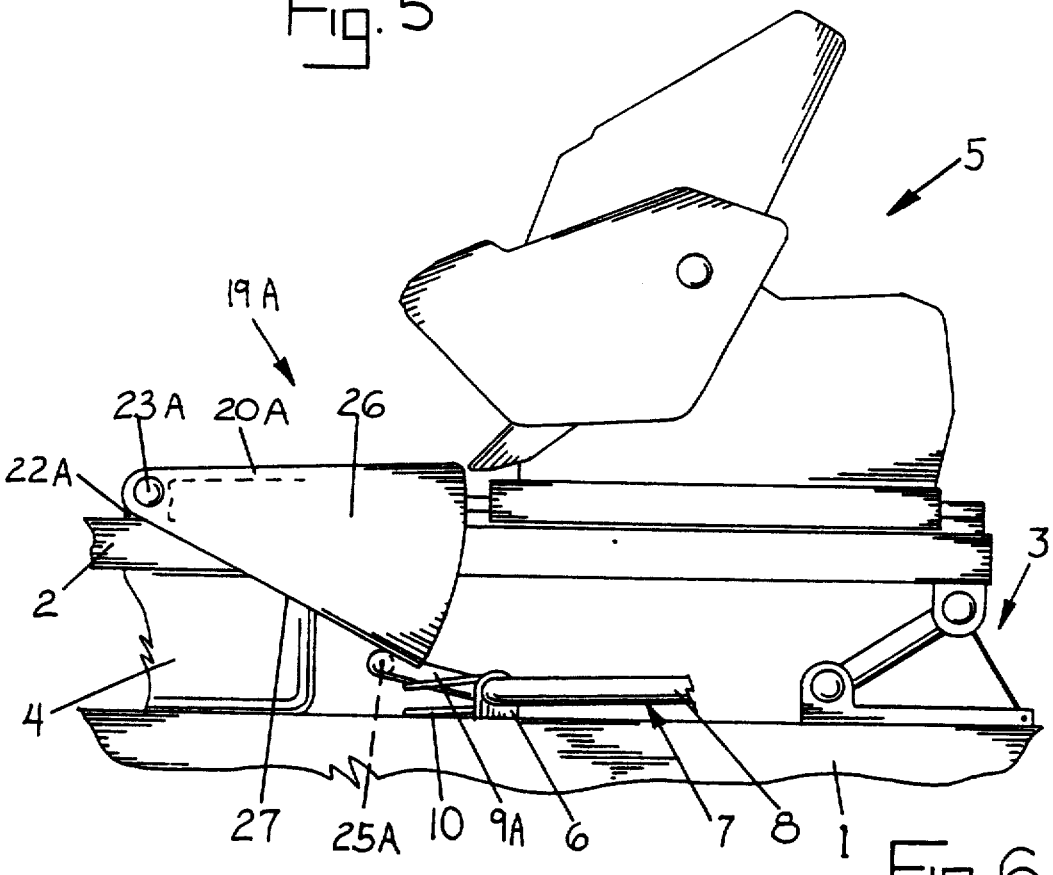
Figure 7:
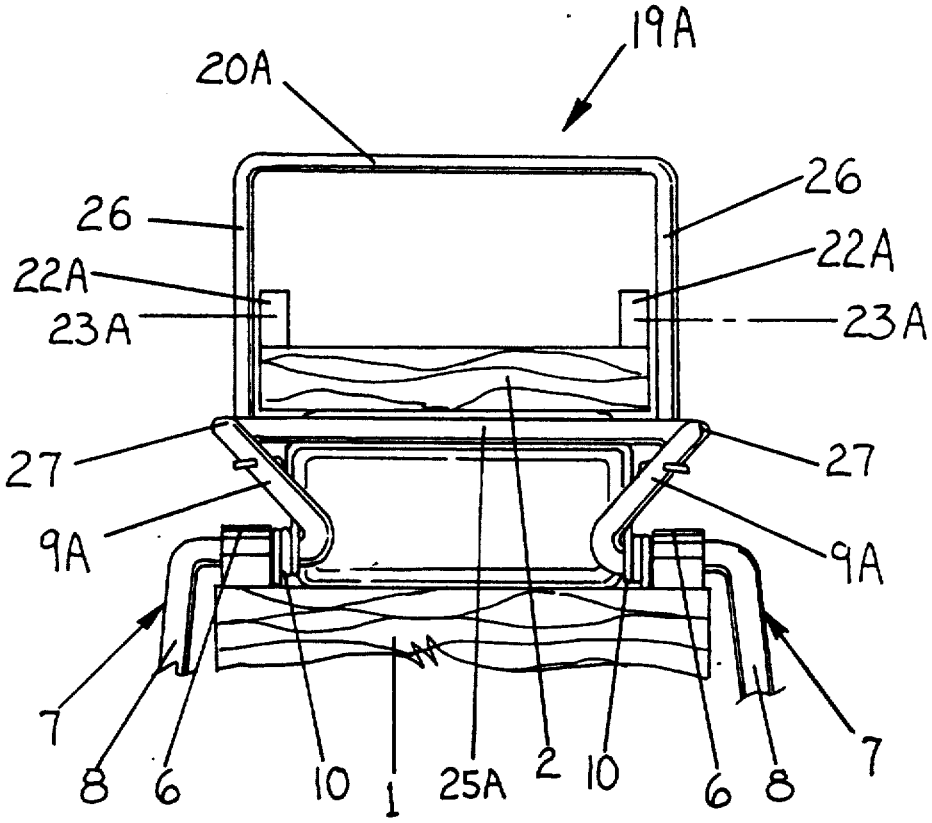

FIGS. 5 to 7 illustrate a second embodiment of the ski brake of the invention. The bearing point 6, the wire-braking arms 7 and the erecting spring 10 are thereby designed substantially the same as in the first exemplary embodiment. The operating member 9*a* is designed barlike with a crossbar 25*a*. The further bearing points 22*a* for the transverse axle 23*a* are mounted in front of the heel holder 5 spaced from the heel holder on the spring board 2. The operating pedal 19*a* has, like in the first exemplary embodiment, a stepping plate 20*a*. The operating pedal 19*a* has downwardly directed sidewalls 26 with lower boundary surfaces 27. The sidewalls 26 are designed approximately sector-shaped in the side view, with its section adjacent to the transverse axle 23*a* being rounded. The lower boundary surfaces 27 of the operating pedal 19*a* act, due to their engagement with the crossbar 25*a*, on the operating member 9*a* to urge the operating member during stepping down of the stepping plate 20*a* in direction toward the upper side of the ski 1. The braking mandrels 8 are thereby, just like before, swung upwardly into the ready position. The lower boundary surfaces 27 of the operating pedal 19*a* can, during a movement of the spring board 2 relative to the ski, press the crossbar 25*a* of the operating member 9*a* still farther downwardly without hindering the spring support of the spring board 2.

The invention is not to be limited to the two illustrated exemplary embodiments. Rather modifications of the same are also conceivable without departing from the scope of the protection.

It would for example be possible to arrange or construct also in a solution similar to the first embodiment the bearing point for the transverse axle of the operating pedal directly on or in the spring board. It would also be possible to provide a separate structural part for the crossbar of the operating member or to construct the structural part in two parts. In the last-mentioned solution, two symmetrically designed control wires with the respective abutments would, if necessary, have to be provided for each ski brake.

The embodiments of the invention in which an exclusive property of privilege is claimed are defined as follows:

1. In a ski brake comprising two wire-braking arms supported in bearing points on a ski, which ski brake is swingable from a braking position, in which said two wire-braking arms are arranged next to side surfaces of the ski and free ends thereof extend below a running surface of the ski, into a ready position, in which a portion of said ski brake remote from said wire-braking arms is urged by a ski boot in direction of an upper side of the ski with the help of an operating pedal means pivotally supported for movement about an axle, an axis of said axle extending transversely with respect to a longitudinal axis of the ski, said free ends of said two wire-braking arms being oriented above a plane of the upper side of the ski, and a first bearing support for said wire-braking arms being arranged on the upper side of the ski, the improvement wherein a second bearing support for the operating pedal means is arranged on a spring board arranged spaced from the upper side of the ski and is movable in a direction normally with respect to the upper side of the ski relative to the ski against the force of a spring, wherein said wire-braking arms have, on a side of said first bearing support remote from said free ends, an operating member, and wherein said operating member is coupled with said operating pedal means by a device permitting the movability of the spring board in direction normally with respect to the upper side of the ski without moving said wire braking arms into said braking position.

2. The ski brake according to claim 1, wherein the device coupling said operating pedal means with said operating member of said wire-braking arms is defined by a jacketed control wire, which includes control wire enclosed by an outer jacket separate from said control wire wherein said outer jacket is supported at its two end sections by two mountings, of which one mounting is fastened on the ski and the other mounting is fastened on the spring board, and wherein said control wire engages at a first end section thereof the operating member and at a second end section thereof a load arm on the operating pedal means.

3. The ski brake according to claim 1, wherein said operating pedal means has downwardly directed sidewalls provided with lower boundary surfaces which engage said operating member of said wire-braking arms.

4. The ski brake according to claim 3, wherein the sidewalls of said operating pedal means, viewed in a side view, have a sector shape, a region of the sector-shape adjacent said second bearing support being rounded.

* * * * *